US006321907B1

(12) United States Patent
Honstrater

(10) Patent No.: US 6,321,907 B1
(45) Date of Patent: Nov. 27, 2001

(54) PLASTIC BAG AND METHOD

(76) Inventor: Richard A. Honstrater, 8540 Mulholland Dr., Los Angeles, CA (US) 90046

( * ) Notice: Subject to any disclaimer, the term of this patent is extended or adjusted under 35 U.S.C. 154(b) by 0 days.

(21) Appl. No.: 09/344,471

(22) Filed: Jun. 25, 1999

(51) Int. Cl.[7] ..... B65D 81/28
(52) U.S. Cl. ..... 206/213
(58) Field of Search ..... 206/213.1, 524.1, 206/524.4; 383/35, 63, 105

(56) References Cited

U.S. PATENT DOCUMENTS 3,973,063 * 8/1976 Clayton ..... 428/35
4,939,151 * 7/1990 Bacehowski et al. ..... 383/35
4,944,916 * 7/1990 Franey ..... 422/8
5,715,945 * 2/1998 Chandler ..... 206/524.4
5,743,435 * 4/1998 Tomic ..... 222/105

* cited by examiner

*Primary Examiner*—David T. Fidei
(74) *Attorney, Agent, or Firm*—Lawrence S. Cohen

(57) ABSTRACT

A system and method for preparing a plastic bag especially useful for carrying electronic products by extruding spaced apart ribs onto the interior surfaces so that the bag volume is greater, so that a greater amount of VCI or anti-static material can be carried in the bag volume and providing greater surface area for outgassing of the VCI into the bag interior. The ribs also facilitate insertion of items into the bag and prevent clinging of the bag interior surface to flat portions of the product carried therein.

5 Claims, 1 Drawing Sheet

PLASTIC BAG AND METHOD

FIELD OF THE INVENTION

This invention relates to plastic bags.

BACKGROUND OF THE INVENTION

Plastic bags are used to contain electronic products. Those electronic products often need very careful handling, such as in clean rooms to avoid contamination. Also, the bags in which the products are to be contained must be appropriately manufactured so as to not introduce contamination. There are also treatments introduced to the bag during its manufacture to benefit the product to be contained. One such treatment is a volatile corrosion inhibitor chemical mixed into the bag raw material before it is formed so that it is contained in the volume of the bag. Consequently the volatile corrosion inhibitor outgasses into the bag interior after the product is put in and the bag is sealed. This protects the product from corrosion during its time in the bag.

Also, such bags may have an antistatic material mixed into the raw material before it is formed and, therefore, contained in the volume of the bag, to discharge static electricity which could damage sensitive electronic components.

All successfully used VCI chemicals have the common property of "Sublimation", the ability to go from a solid to a gas without going through a liquid phase. This property is effected by temperature, as an increase in temperature will cause more chemicals to become a gas. By placing the chemical in an enclosure, the entrapped vapor will soon saturate the air causing the reaction to come to equilibrium and slow down or stop any further gas production. Cool and/or cold temperatures slow down both the corrosion reaction and the sublimation reaction.

The most effective enclosures have been made from plastic materials. These materials inherently have good moisture and oxygen barrier properties. The end result is small amounts of VCI produce maximum protection levels. In addition the plastic materials are effective in protecting the metal from dust, dirt and abrasion problems. All together leading to a successful package.

The ability of the VCI materials to work in conjunction with many of the antistatic control additives that are currently used in plastic packaging material, further enhances the successful use of VCI's in the electronics market A single material with the dual protective properties offers ideal solutions to most of the industries corrosion and protection problems, Small amounts of VCI materials can be blended with the antistatic additives during production of the plastic part or film.

A further benefit of non-contamination of the surface of an electronic element is experienced with VCI materials. A small amount of the chemical deposit on the metal is quickly removed when the enclosure is removed (the part is taken out of the package). 100% removal is achieved in very little time (15–20 minutes max.). With the miniaturization that has occurred in the electronic industry, contamination has become a huge problem. A super clean package is absolutely required. Testing has proven that VCI chemistry is a safe and effective packaging material for this market.

Plastic film, used in making bags or covers for metal parts, is usually smooth. This can cause a problem in some packages where the geometry of the metal part could expose a smooth side of the metal to contact the smooth plastic. The attraction between two smooth surfaces (van der Waals forces) can cause sticking and/or staining of the metal surfaces. Rough surfaces are not desirable because of abrasion.

In addition, during periods of high humidity a thin layer of moisture will develop inside an enclosure (Green House effect) and a pool of water will develop in these smooth areas effectively blocking the VCI from reaching the metal. Corrosion develops in these areas and is at times a serious problem. A need to protect the metal from this pooling effect is essential to many otherwise good package designs.

Further, there is, in some cases difficulty in inserting the product into the bag due to the surface friction between the bag and the product, or possible snagging of the product on the bag's interior surface. Also, bags which have flat surfaces may cling to the flat surface of a printed circuit board which can be detrimental to that portion of the printed circuit board.

SUMMARY OF THE INVENTION

The present invention provides advantages in the respect of the foregoing problems. During extrusion of the bag, a series of longitudinal ribs are provided integrally with the interior of the bag. These longitudinal ribs provide added volume to the bag and added surface area to the inside of the bag. Consequently, more of the volatile corrosion inhibitor (VCI) can be stored and there is a larger surface area over which to outgas resulting in a greater volume of the VCI gas introduced inside the bag over a shorter time as well as availability of VCI over a longer time. Thus the invention lies in a method of enhancing the storage volume and consequently the rate and time period of outgassing of the VCI by providing longitudinal ribs which increase the total volume of the bag and the interior surface area of the bag.

Similarly, the amount of antistatic material which can be disposed in the bag volume is increased if the bag volume is increased.

Also, the longitudinal ribs allow the product to be inserted into the bag more easily by reducing friction and preventing snagging of corners or other sharp portions of the product on the bag's interior surface.

Also, the ribs prevent any portion of the bag from clinging to a flat surface, such as a printed circuit board.

DETAILED DESCRIPTION

Figure 1:
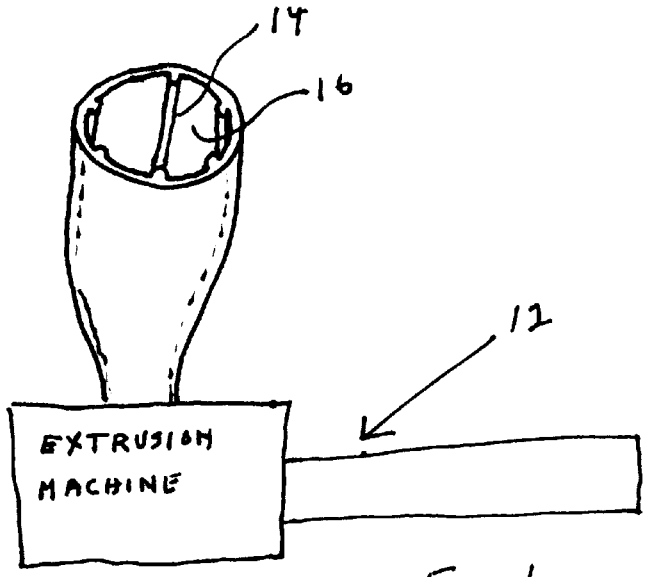
FIG. 1 is a drawing of a plastic bag according to the invention being created by a conventional extrusion process.

FIG. 1 shows in partial schematic form the extrusion of a bag. Exiting from the extrusion machine 12 the continuous tube of extrusion product 10 will be made into bags. The extrusion tube 10 will be laid flat in a roll or sent directly in the laid flat condition to the subsequent procedures. Those procedures include forming individual bags by cutting and sealing to have a sealed bottom and an open top, with the ribs of the present invention extending from top to bottom of the bag. The extrusion process is conventionally performed to provide a tube of plastic, which is continuously formed, and laid into a nip roll. It is then further processed to form bags. The extrusion machine is shown schematically at 12. According to the present invention the extrusion product 10 has ribs 14 on the interior surface 16, which will be the inside of the bag.

Figure 2:
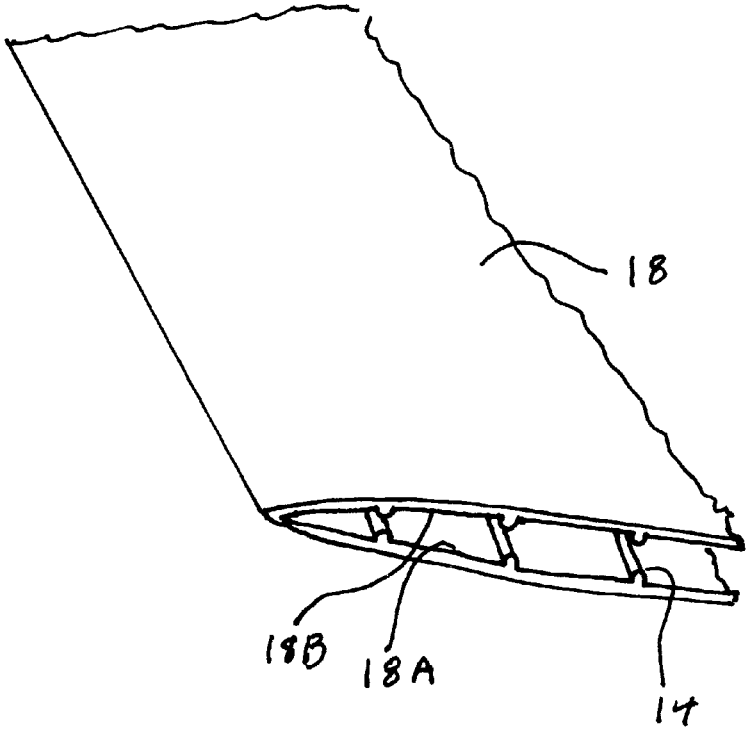
FIG. 2 is a partial section view of a plastic bag made according to the invention.
Figure 3:
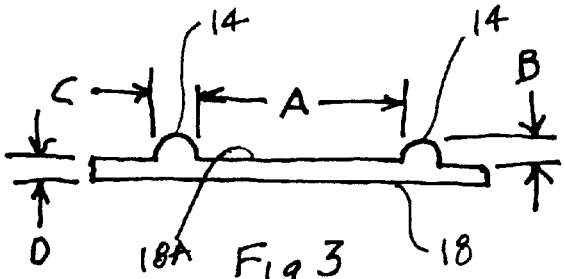
FIG. 3 is an enlarged partial view showing the ribs and designating various relevant dimensions.

Referring to FIGS. 2 and 3 the ribs 14, are spaced apart by the dimension A, have a height dimension B and a thickness dimension C.

The spaced apart dimension A preferably ranges from about 0.200 inch to about 0.750 inch, and is preferably about 0.500 inch.

The height dimension B preferably ranges from about 0.020 inch to about 0.060 inch, and is preferably about 0.030 inch.

The width dimension C preferably ranges from about 0.025 inch to about 0.060 inch, and is preferably about 0.030 inch. As illustrated the preferred shape of the ribs 14 is rounded from a die having a circular opening, although other shapes can be achieved by selected die design, for example the rib could be rectangular or square.

The relationship of the web thickness to the rib height preferably ranges from about 3:1 to 10:1, and preferably about 4:1.

The relationship between the rib width and the rib height is preferably about 3:1 to 1:1.

As shown in FIG. 2, the ribs 14 are aligned on opposite inside surfaces 18A, 18B of the bag. Alignment of or non-alignment of the ribs 14 on the opposite sides 18A, 18B is considered to be of no consequence. In normal extrusion the bag is formed as a continuous circle. It is then laid flat to define the two sides of the bag.

It is noted that a normal effect of the extrusion process creates a small lump on the opposite side of the film opposite the rib; but this is not illustrated.

By introducing the ribs 14 into a plastic bag which is otherwise of conventional structure, the total of the bag volume is greater. The term bag volume refers to the volume of plastic material of which the bag is formed.

In processes in which additives are to be introduced into the plastic mass or volume of plastic which is to become the bag, the additive is introduced and mixed into the plastic before it is fed through the extrusion die. In a typical case this mixing occurs by use of a screw which advances the raw material toward the extrusion die, mixing it in the process. In this manner when volatile corrosion inhibitor (VCI) material is to be used, it is added to the chamber containing the raw plastic material (usually beads) so that when the bag is formed the plastic bag volume includes a quantity of the VCI evenly dispersed throughout the film.

According to the present invention the extrusion die is made so that the ribs 14 will be formed as the plastic material passes through the extrusion die. The ribs 14 therefore provide that the bag will have a greater plastic volume. Since the bag will have a greater plastic volume, it will have a greater quantity of VCI blended throughout the volume.

With more VCI in the plastic bag volume, there will be more VCI to outgas over time into the bag's interior space. Therefore, the availability of protection afforded by the VCI will extend over a longer time.

Also the ribs 14 increase the interior surface area 18A, 18B of the bag so that the VCI can outgas at a faster rate.

Similarly, an anti-static material can be added to the plastic mix. The ribs 14 provide similar benefits to the availability of the anti-static material on the inner surface of the bag.

The ribs 14 serve yet another beneficial purpose. For some electronic components such as printed circuit boards greater ease of opening the bag and insertion is beneficial. The ribs 14 provide such benefits as it is easier to open the bag and a circuit board as it is inserted rides on the ribs 14. Also, after insertion in a conventional bag, areas of a circuit board can have the bag clinging to it sealing it off from access to VCI gas and creating risk of concentrated static discharge which can damage the electronics. The ribs 14 prevent such clinging and sealing off so that VCI gas can flow around and be in more complete contact with the stored item.

A further advantage is that the ribs give the bag greater tensile strength and elongation limit in the machine direction. The greater the cross sectional volume of the rib, the greater is this advantage.

Although particular embodiments of the invention have been described and illustrated herein, it is recognized that modifications and variations may readily occur to those skilled in the art, and consequently it is intended that the claims be interpreted to cover such modifications and equivalents.

What is claimed is:

1. A plastic bag comprising first and second opposed sides of rectangular shape the opposed sides joined alone their sides to define a bag having only two thicknesses across the width and having one end open and having an interior surface on each of said first and second sides and a plurality of spaced apart parallel longitudinal ribs on each of said interior surfaces said ribs extending spaced apart substantially across the entire width of said interior surfaces between said joined sides.

2. The plastic bag of claim 1 further wherein said ribs are spaced apart from about 0.200 inch to about 0.750 inch.

3. The plastic bag of claim 2 further wherein said ribs have a height from about 0.020 inch to about 0.060 inch.

4. The plastic bag of claim 1 wherein the ratio of the distance the ribs are spaced apart to their height is from about 3:1 to 10:1.

5. The plastic bag of claim 1 wherein the ratio of the rib width to the rib height is from about 3:1 to 1:1.

* * * * *